US009431231B2

(12) United States Patent
Flechsig et al.

(10) Patent No.: US 9,431,231 B2
(45) Date of Patent: Aug. 30, 2016

(54) LAMP WITH GRADED ABSORPTION COATING

(75) Inventors: Juergen Flechsig, Plauen (DE); Martin Tobias Polster, Pausa (DE); Hans-Alo Dohmen, Aldenhoven (DE); Ralph Kecke, Plauen (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 13/818,708

(22) PCT Filed: Aug. 24, 2011

(86) PCT No.: PCT/IB2011/053716

§ 371 (c)(1), (2), (4) Date: Feb. 25, 2013

(87) PCT Pub. No.: WO2012/028996

PCT Pub. Date: Mar. 8, 2012

(65) Prior Publication Data

US 2013/0154466 A1 Jun. 20, 2013

(30) Foreign Application Priority Data

Aug. 30, 2010 (EP) ..... 10174503

(51) Int. Cl.
*H01J 61/40* (2006.01)
*H01J 61/38* (2006.01)
(Continued)

(52) U.S. Cl.
CPC ..... *H01J 61/40* (2013.01); *H01J 9/20* (2013.01); *H01J 61/025* (2013.01); *H01J 61/35* (2013.01); *H01K 1/32* (2013.01)

(58) Field of Classification Search
CPC ..... H01K 1/26–1/325; H01J 2261/00; H01J 2261/02; H01J 2261/38; H01J 2261/385; H01J 61/40; H01J 61/38
USPC ..... 313/489, 111, 112, 635; 427/105, 106, 427/230–232, 235
See application file for complete search history.

(56) References Cited

U.S. PATENT DOCUMENTS 1,500,912 A 7/1924 Williams
3,205,394 A * 9/1965 Ray ..... 313/489
(Continued)

FOREIGN PATENT DOCUMENTS

DE 19841304 A1 3/2000
EP 460913 A2 * 12/1991
(Continued)

OTHER PUBLICATIONS

EPO as ISA, International Search Report and Written Opinion mailed Mar. 26, 2012 from International Application No. PCT/IB2011/053716 filed Aug. 24, 2011, 20 pages.
(Continued)

*Primary Examiner* — Mariceli Santiago

(57) ABSTRACT

The invention describes a lamp (1A, 1B, 1C, 1D) comprising a glass envelope (10) enclosing a light generating means (11), and an axially and/or circumferentially graded absorption coating (2A, 2B, 2C, 2D) applied to a surface of the glass envelope (10), wherein the graded absorption coating (2A, 2B, 2C, 2D) exhibits a smooth transition in a transition region (23A, 23C, 23D) from a first coated region (21 A, 21B, 21C, 21D) on the glass envelope (10) to a second coated region (22A, 22B, 22C, 22D) on the glass envelope (10). The invention further describes a lighting assembly (4) comprising a lamp according to any of claims 1 to 11 and a reflector (40) for collecting and shaping any light passing through the graded absorption coating (2A, 2B, 2C, 2D) of the lamp (1A, 1B, 1C, 1D). The invention also describes a method of manufacturing a lamp (1A, 1B, 1C, 1D) comprising a glass envelope (10) enclosing a light generating means (11), which method comprises applying an axially and/or circumferentially graded absorption coating (2A, 2B, 2C, 2D) to a surface of the glass envelope (10) such that the graded absorption coating (2A, 2B, 2C, 2D) exhibits a smooth transition in a transition region (23A, 23B, 23C, 23D) from a first coated region (21A, 21B, 21C, 21D) to a second coated region (22A, 22B, 22C, 22D).

20 Claims, 4 Drawing Sheets

(51) Int. Cl.

| | |
|---|---|
| ***H01J 9/20*** | (2006.01) |
| ***H01J 61/35*** | (2006.01) |
| ***H01K 1/32*** | (2006.01) |
| ***H01J 61/02*** | (2006.01) |

(56) References Cited

U.S. PATENT DOCUMENTS

| | | | | |
|---|---|---|---|---|
| 3,215,883 | A | 11/1965 | McClees | |
| 5,227,693 | A * | 7/1993 | Sakakibara et al. | 313/489 |
| 5,243,251 | A * | 9/1993 | Inukai et al. | 313/635 |
| 6,369,510 | B1 | 4/2002 | Shaw et al. | |
| 2004/0222727 | A1 | 11/2004 | Schaefer et al. | |
| 2005/0023983 | A1 | 2/2005 | Israel et al. | |
| 2007/0247050 | A1 * | 10/2007 | Van Spang | H01J 61/35 313/317 |

FOREIGN PATENT DOCUMENTS

| | | | | |
|---|---|---|---|---|
| EP | 0986093 | A1 | | 3/2000 |
| HU | 9902777 | A2 | | 4/2000 |
| JP | 02112127 | A | * | 4/1990 |
| JP | H05-129006 | A | | 5/1993 |
| JP | 06338297 | A | * | 12/1994 |
| JP | 6338297 | A | | 12/1994 |
| JP | 2000090887 | A | | 3/2000 |
| JP | 2002151004 | A | | 5/2002 |
| JP | 2002157977 | A | | 5/2002 |
| JP | 2007-317567 | A | | 12/2007 |
| KR | 2000023011 | A | | 4/2000 |
| KR | 398557 | B | | 9/2003 |
| WO | 2006018799 | A1 | | 2/2006 |
| WO | 2010055458 | A1 | | 5/2010 |

OTHER PUBLICATIONS

Office Action mailed Apr. 21, 2015 from Japanese Application No. 2013-525403.

Office Action mailed Apr. 5, 2016 from Japanese Application No. 2013-525403.

First Office Action issued Jun. 24, 2015 from Chinese Application No. 201180041960.7.

Second Office Action issued Jan. 18, 2016 from Chinese Application No. 201180041960.7.

Office Action issued Aug. 13, 2015 from European Application No. 11760569.1.

Office Action issued Jan. 19, 2015 from European Application No. 11760569.1.

"Philips Master Duty", Aug. 1, 2008, retrieved from the Internet: URL:http://www.lighting.philips.com/pwc_li/gb_en/application_areas/assets/documents/automotive/mdbv_leaflet_en.pdf (retrieved on Aug. 6, 2015).

* cited by examiner

LAMP WITH GRADED ABSORPTION COATING

FIELD OF THE INVENTION

The invention describes a lamp with a graded absorption coating, a lighting assembly comprising such a lamp, and a method of manufacturing such a lamp.

BACKGROUND OF THE INVENTION

In automotive lighting applications, several different types of lamp can be used to generate a beam in front lighting applications. For example, filament lamps such as the H7 lamp are widely used in reflector assemblies that use a reflector to shape the beam, while discharge lamps such as the D4 lamp are well known for use in projector headlamps that use a lens as well as a reflector to shape the beam. Filament lamps such as the H-series lamps generate a mainly white light that may be perceived to be yellowish in colour. In contrast, the more modern high-intensity discharge (HID) lamps (often simply referred to as "xenon" lamps) generate a very bright light with a distinct blue hue. However, an existing filament lamp cannot simply be replaced by a better and more xenon lamp, since the reflector for a filament lamp is only approved for those filament lamp types covered by the UNECE (United Nations Economic Commission for Europe) regulations such as regulation R37. Therefore, some efforts have been invested in altering the exterior of a conventional lamp to modify its beam properties. For example, a prior art lamp has been modified to include a coating in a region of the lamp close to the base, leaving the rest of the lamp surface uncoated. The purpose of the coating is to alter the colour of the light emitted towards the base of the lamp while leaving the beam unaffected. Other lamps are known in an interference filter is applied to the surface of the lamp to alter the beam. However, such an interference filter is quite expensive to apply, since several very thin but very uniform layers in the region of a few tens of nanometers must be applied in succession.

Therefore, it is an object of the invention to provide a more efficient and robust way of modifying the light and colour output of a lamp while complying with the relevant regulation.

SUMMARY OF THE INVENTION

The object of the invention is achieved by the lamp according to claim 1, the lighting assembly according to claim 11, and the method of coating a lamp according to claim 13.

According to the invention, the lamp comprises a glass envelope, and an axially and/or circumferentially graded absorption coating applied to a surface of the glass envelope, wherein the graded absorption coating exhibits a smooth transition in a transition region from a first coated region on the glass envelope to a second coated region on the glass envelope.

An obvious advantage of the graded absorption coating on the lamp according to the invention is that the properties of the beam generated by the lamp can be altered in such a way that the main beam—formed largely with light exiting the lamp in the vicinity of the light generating means—is altered only to an extent governed by the first coated region, while light exiting at an outer region, for example an end-region close to the base of the lamp, is altered to a different extent governed by the second coated region, without any sharp distinction or pronounced 'step'. In other words, the main beam and outer parts of the beam blend into each other in a smooth transition according to the smooth transition between the first and second coated regions, unlike the effect which would be reached if the coating were to comprise a distinct boundary between the first and second regions. With appropriate choice of material for the graded coating and with appropriate application of the coating, a basic and relatively cheap automotive filament lamp can easily be altered to deliver a desired beam performance, while ensuring that the lamp still satisfies any automotive lighting regulations, thus making the lamp according to the invention particularly attractive for the "aftermarket" or original equipment manufacturer (OEM).

According to the invention, the lighting assembly comprises such a lamp and a reflector for collecting and shaping any light passing through the graded absorption coating of the lamp. When the lamp is operational, light generated by the light generating means of the lamp—for example a filament in a halogen lamp or a discharge arc in a high-intensity discharge lamp—will be collected by the reflector and shaped into a beam with a smooth transition between its central and outer regions, as described above. When the lamp is off, any stray light passing through the lamp will be altered according to the graded coating and collected by the reflector, so that the appearance of the lamp in the reflector can be altered even when the lamp is not operational.

According to the invention, the method of manufacturing a lamp comprising a glass envelope enclosing a light generating means comprises the step of applying an axially and/or circumferentially graded absorption coating to a surface of the glass envelope such that the graded absorption coating exhibits a smooth transition in a transition region from a first coated region to a second coated region.

The dependent claims and the following description disclose particularly advantageous embodiments and features of the invention. Features of the embodiments may be combined as appropriate.

The lamp and the lighting assembly according to the invention can be used in any suitable application. However, such a lamp may be mostly used in an automotive application such as a front beam or fog beam assembly. Therefore, in the following, it may be assumed that the lamp and lighting assembly are intended for an automotive application, without however restricting the invention in any way. Furthermore, the modifications described herein could be carried out on the glass envelope of a filament lamp such as a H4 or H7 lamp, a 9005 lamp, a 9006 lamp, etc., but may also be carried out on the outer glass envelope of a gas-discharge lamp such as a D-series lamp, even though reference is more often made to a filament lamp in the following. Also, an automotive lamp in a reflector-based lighting assembly is generally mounted horizontally in the reflector, with the tip of the lamp facing 'outward' and the base of the lamp is mounted in a socket held in the bowl of the reflector. This convention may be assumed in the following, without however restricting the invention in any way. For an automotive low beam application, one end of the lamp (the tip) is usually covered by an opaque anti-glare cap, and the other end is attached to a base or socket. The light generating means or light source, for example the filament of a halogen lamp or the burner of an HID lamp, is generally positioned such that images of the light source are collected at the sides of the reflector, which casts these images into a beam profile with a bright/dark cut-off and a shoulder region, as will be known to the skilled person. Light emitted from the 'top' and 'bottom' of the lamp, and light escaping towards the base of the lamp, makes no significant contribution to the beam and may only appear at the 'edges' of the beam. The region on the glass envelope of the lamp in the 'vicinity' of the light source is therefore to be understood to be that region from which the 'useful' light is emitted from the lamp during operation, while an 'outer region' can refer to any other region on the lamp envelope through which the 'less useful' light is emitted, for example a region close to the tip or a region close to the base.

The graded coating can act in various ways on the light that passes through the coating. For example, it may be desirable to slightly alter the colour of the light, to slightly alter its path, etc. However, the light emitted by an automotive headlamp must satisfy certain regulations such as the ECE-R37 and ECE-R112 (filament lamps) or ECE-R98 and ECE-R99 regulations (gas-discharge lamps), which dictate the tolerances for the light output of filament lamps, the beam shape, and the permissible colour range of the lamp. Therefore, in a particularly preferred embodiment of the invention, the first coated region (in the region of the light source of the lamp) and the second coated region (an end-region of the glass envelope) differ in layer thickness and/or particle density and/or layer count and/or colour, so that the light that contributes to the beam can be altered to an extent in keeping with the relevant regulation, while other light that makes no significant contribution to the beam can be altered to a greater extent.

The main part of the beam generated by a lamp in a lighting assembly originates from the central part of the lamp in which the light source is positioned. Again, the light source can be a filament in the case of a filament lamp, or a burner in which a discharge arc is generated in the case of a gas-discharge lamp. Light leaving the lamp at one or both ends generally does not make any significant contribution to the front beam. Therefore, in a particularly preferred embodiment of the invention, the first coated region is applied in the vicinity of the light generating means of the lamp, and a second coated region is applied to an outer region of the glass envelope. For example, in the case of a H7 filament lamp, the first coated region can comprise the region on the surface of the glass envelope between the anti-glare cap and the lower end of the filament, effectively including the entire filament, while the second coated region can comprise the remainder of the surface of the glass envelope down to the base of the lamp.

Preferably, the emitted light is absorbed only to a certain degree by the coating, since a high level of light output is usually desired. Particularly in the case of a lamp used for an automotive application, the light output must satisfy the relevant regulations. Therefore, in a preferred embodiment of the invention, a coated region preferably absorbs at most 40%, more preferably at most 15%, of the light passing through that coated region. For example, in one embodiment, the first coated region may absorb only 15% of the light, since the light emitted in this region essentially entirely contributes to the front beam, while stray light exiting towards the base of the lamp makes no significant contribution to the beam and can therefore be manipulated to a greater extent without any negative impact on beam performance and safety, so that the second coated region could absorb up to 40% of the light.

The absorption coating can be graded axially and/or circumferentially. An axially graded coating can comprise a first coated region applied to surround the envelope towards one end of the lamp, a second coated region applied to surround the envelope towards the other end of the lamp (for example towards the base), and a transition region, around the circumference of the envelope, given for example by an overlap between the first and second coated regions. A circumferentially graded coating can comprise first and second coated regions applied along the length of the envelope, with a transition region also along the length of the envelope, given for example by an overlap between the first and second coated regions. A circumferentially varying coating can provide specific light emission qualities for the different regions of the reflector, so that a front beam with slightly coloured regions can be generated. For example, a yellow second coated region on the right-hand side of the glass envelope can result in a yellowish light below the left-hand side of the bright/dark cut-off for that beam. Evidently, a graded absorption coating can be axially as well as circumferentially graded, for example by applying a coating along the length of the glass envelope such that it has a thin region at one end and a thicker region at the other. Alternatively, a combination of a circumferentially and an axially graded coating can be applied at an angle, for example by applying the first and second coating regions at an angle of 20°-30° to the optical axis of the lamp.

Since the light contributing to the main part of the front beam is preferably only slightly modified, while the remainder of the light can be modified to a greater extent, in a further preferred embodiment of the invention the graded absorption coating has a thickness in the range 200 nm to 500 nm in the first coated region and in the range 500 nm to 1000 nm in the second coated region. For example, a thin coated region with 300 nm coating thickness can blend into a 'thickly' coated region with 800 nm coating thickness over a transition distance of 3 mm, so that this graded coating has a slope of about $0.167\times10^{-3}$. In this way, the slight alteration to the light originating from the region around the actual light source can ensure that the beam still satisfies the relevant regulation, while the light exiting the lamp through an end of the envelope can be altered to a greater extent without detracting from the beam performance. For example, if the coating acts to alter the colour of the light exiting the lamp, the main beam is only very slightly affected, while any light exiting the base of the lamp is affected to a greater degree, as will be explained below. The thickness of the coating results in a favourable robustness, since such a relatively thick layer can easily withstand the high temperatures reached during operation of the lamp and will not be prone to separate from the glass.

It may be desired to alter the colour of the light emitted by the lamp. Therefore, in a further preferred embodiment of the invention, the first coated region comprises an absorption coating with a low density of absorption particles, and the second coated region comprises an absorption coating with a high density of absorption particles. With such a graded coating, the light contributing to the main beam is only subject to a low level of absorption, with only a slight colour change or no colour change at all, while the remainder of the light is subject to more absorption. For example, the desired effect may be to leave the colour of the main beam essentially unchanged, and to only modify the colour of the light exiting the lamp near the base. Alternatively, it may be desirable to apply coatings with different colour nuances, so that, for example, one coated region alters the light to give it a first colour nuance, while another coated region gives that portion of the light a different colour nuance. In this way, a front beam can be generated having different beam portions with different colour nuances. These and other effects may be achieved by appropriate choice of the absorption materials in the first and second coated regions.

Equally, it may be desired to minimise any refraction effect of the coating. Therefore, in a further preferred embodiment of the invention, a refractive index of the first coated region and a refractive index of the second coated region differ by at most 0.2. In this way, the light portions exiting the lamp in the first and second coated regions are not very differently refracted. For example, the first coated region could comprise an absorption material with a first refractive index close to 1.0, so that this layer only slightly refracts the exiting light, and the second coated region could comprise an absorption material with a second refractive index slightly greater than 1.0, so that the light is only slightly more refracted when leaving the lamp in this region, and the difference between the effect on the main part of the beam and the effect on the remainder of the light is not too pronounced.

As mentioned above, the graded coating can have a first region that is thinner than the second region. This variation in thickness can be achieved in a number of ways. For example, in a preferred embodiment of the invention, the number of layers in the first coated region is less than the number of layers in the second coated region. This can be achieved, for example, by applying one or more layers essentially to the entire outer surface of the glass envelope. One or more subsequent layers can then be applied to a lower region of the lamp below the position of the light source, for example below the filament of a filament lamp. Preferably, to maintain a high robustness at the high temperatures reached during operation, only one layer is applied to the entire surface and only one subsequent layer is applied in the second region. In this realisation, the second region comprises only two layers. The material properties of the first layer and its thickness can be chosen to have a favourably minor effect on the main beam, while the material properties of the second layer and its thickness can in turn be chosen to have a greater, more noticeable effect on the rest of the light. Of course, the layers can be applied in any order. For instance, the layer(s) of the second coated region could be applied first, and one or more subsequent layer can than be applied to essentially coat the entire surface of glass envelope as well as the underlying layers of the second coated region.

For the embodiments mentioned above, the main beam was modified only slightly, while the light exiting the lamp at the base was modified to a greater extent. Of course, the functions of the first coated region and second coated region can be reversed, i.e. the first coated region can be thicker, can have an additional layer, or can have a higher density of absorption particles, etc., than the second coated region. Such an embodiment may be suited for applications in which a pronounced alteration of the main beam is desired, while only slightly modifying the rest of the light. A further alternative embodiment might comprise an axially graded absorption coating with alternating first and second coated regions, with transition regions between each neighbouring first and second region, in the manner of 'stripes' or 'bands' around the glass envelope. In such an embodiment, the stripes or bands may be correspondingly dimensioned, so that, for example, four, five or more bands can be applied to the surface of the glass envelope. With such an embodiment, the lamp can be used in a reflector-based lighting assembly to provide a very specific beam as regards the 'placement' of colour nuances in specific parts of the beam profile.

The graded coating can be applied using any suitable technique, for example by sputtering one or more coating layers onto the glass envelope. In a preferred embodiment of the invention, however, the step of applying the axially and/or circumferentially graded absorption coating comprises the steps of immersing the glass envelope in a coating bath of absorption material, partially withdrawing the glass envelope from the coating bath at a first rate of withdrawal, and completely removing the glass envelope from the coating bath at a second rate of withdrawal. The thickness of the coating may depend on several factors, for example the wettability of the liquid coating, its surface tension and viscosity, and the speed at which the lamp is withdrawn from the coating bath. The graded absorption coating can comprise a single layer of an absorption material, while still being thinner in the first coated region than in the second coated region. Such a realisation can be preferred depending on the material properties of the absorption coating, since the absence of layer boundaries can favourably prolong the lifetime of the coating. In one embodiment of the method according to the invention, the graded single coating can be applied by holding the lamp at its base and immersing the lamp (tip downwards) in a coating bath and then lifting it from the bath at a first, higher speed to obtain a relatively thick first coated region, and then decreasing the speed gradually to obtain a transition region with decreasing thickness, and proceeding to raise it from the bath at a lower speed to obtain a relatively thin second coated region. Evidently, the point at which the speed is decreased can be chosen according to a desired 'boundary' between first and second coated regions, and the speed can be adjusted to obtain a uniform gradient over this boundary. Alternatively, beyond a certain point, for example below the position of the light source, the speed can be progressively decreased to obtain a gradually increasing thickness over the entire second coated region. Such techniques are straightforward and result in a favourable homogenous absorption coating. Clearly, different layers of absorption material can be achieved by successively dipping the lamp into baths of different materials.

A circumferentially graded coating, in which a first coated region runs the length of the glass envelope, may be preferred for some lighting applications. Therefore, in a further preferred embodiment of the invention, the step of applying the graded absorption coating comprises the steps of applying the coating essentially to the entire surface of the envelope in a desired thickness for the second coated region, and removing a portion of the coating in an area corresponding to the first coated region such that only a thin layer of the absorption coating remains in that area. For example, the glass envelope can be drawn out of the bath (at uniform speed for an even coating all round; or at varying speeds for an additional axial gradient) and the coating can then be partially removed from the first coated region by passing a suitable scraper or other tool over this region to leave a relatively thin first coated region and a thicker second coated region. Alternatively, a jet of air can be directed at an area of the still liquid coating to 'push' the coating outward from that area, leaving a thinner layer corresponding to a first coated region. Of course, any other appropriate technique could be applied to obtain the desired distribution of the coating in the first and second regions.

The different realisations of the first and second coatings can be realised in desired combination regarding layer thickness, particle density, layer count, colour, etc. For example, a first coating having a single layer with a certain layer thickness and a certain particle density can be combined with a second coating comprising one layer with a certain colour nuance and a further layer with a certain density of absorptive particles. Evidently, any number of possible combinations can be realized. Any suitable material can be used for the different regions of the coating, for example a transparent lustre coating or a lustre coating with a pronounced colour or a colour nuance.

As mentioned in the introduction, vehicles equipped with conventional lighting assemblies for filament lamps cannot simply be 'upgraded' to use to the newer type of lamps, considered by many to be desirable, for technical reasons. Light emitted by a "xenon" headlamp is characteristically blue in colour. In contrast, light emitted by a filament lamp is yellowish-white. Therefore, in a preferred embodiment of the invention, the material of the graded absorption coating is chosen to raise the colour temperature of the lamp by about 100K-2500K compared to an uncoated lamp. To this end, in a preferred embodiment of the invention, the material of the graded absorption coating comprises an essentially blue-coloured material such as cobalt aluminate ($CoAl_2O_4$). Other materials may also be equally suitable, for example bismuth vanadium oxide ($BiVO_4$), ferric oxide ($Fe_2O_3$) and a metal oxide lustre coating, etc.

The width of the transition region between the first coated region and the second coated region is preferably chosen to provide a smooth transition between the altered parts of the light emitted from the lamp. For example, for a H7 lamp, the transition between a thin first coated region and a thicker second coated region can be about 4 mm, commencing at a point at which the filament ends and progressing in the direction of the lamp base. In another example, the transition between a first coating having a low density of absorption particles and a second coating having a high density of absorption particles can also extend over a band with a certain width, within which the two materials are mixed with the first material being phased out and the second material being phased in.

Since most candidate replacement lamps are H7 lamps, a preferred embodiment of the lighting assembly according to the invention comprises a H7 filament lamp in a suitable reflector, and the graded absorption coating is applied over the entire surface of the glass envelope of the lamp such that the first coated region is applied in the region of the filament, and the second coated region is applied to an end-region of the glass envelope below the filament.

By altering the exterior of the lamp as described above, a conventional lamp can, with relatively little effort, be altered to provide a beam with one or more specifically modified regions, or to appear as a more expensive "xenon" lamp, whether or not the lamp is in its operational state. For example, the first coated region can be chosen and applied to move the colour point of the beam towards the blue region during operation of the lamp, i.e. to slightly increase the colour temperature of the beam but without altering the beam profile. A second coated region can be designed to give a yellow nuance to the predominantly white light exiting the lamp to one side of a lower region, causing the corresponding region in the front beam (close to the vehicle and below the cut-off) to take on a yellowish cast. A second coated region can be designed to change the light exiting the lamp in the lower region into a noticeably blueish white light, which does not contribute to the beam, but which gives the visual impression of "blueness", when looking into such the lighting assembly Any traffic participant looking into such an assembly may be given the impression that the lamp is a xenon lamp.

BRIEF DESCRIPTION OF THE DRAWINGS

In the drawings, like numbers refer to like objects throughout. Objects in the diagrams are not necessarily drawn to scale.

DETAILED DESCRIPTION OF THE EMBODIMENTS

Figure 1:
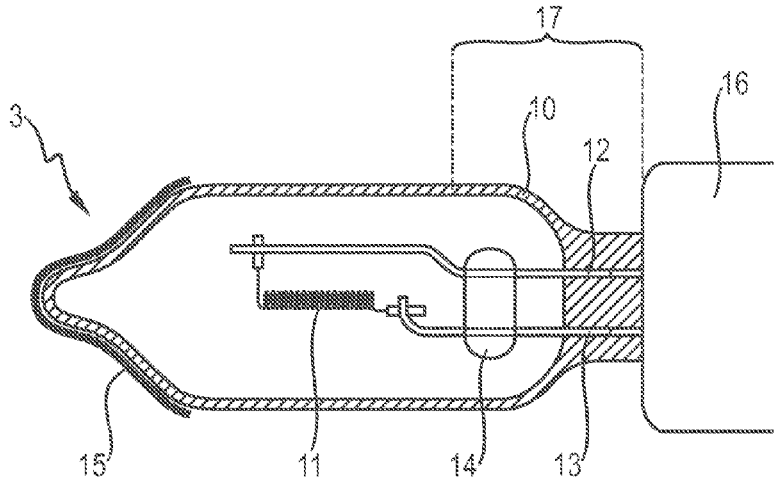
FIG. 1 (prior art)
FIG. 1 shows a schematic representation of a prior art filament lamp for an automotive application.

FIG. 1 shows a schematic representation of a H7 filament lamp 3 with a quartz glass envelope 10 and a filament 11 supported by two electrodes 12, 13. A quartz glass bead 14 secures the electrode legs within the envelope 10, which is sealed by pinch and mounted onto a base or socket 16. An opaque cap 15 is attached to the tip of the lamp 3 to reduce glare produced by the lamp 3 when used in an automotive headlamp. The light produced by this type of lamp 3 is mainly white and may have a yellowish tinge.

Figure 2:
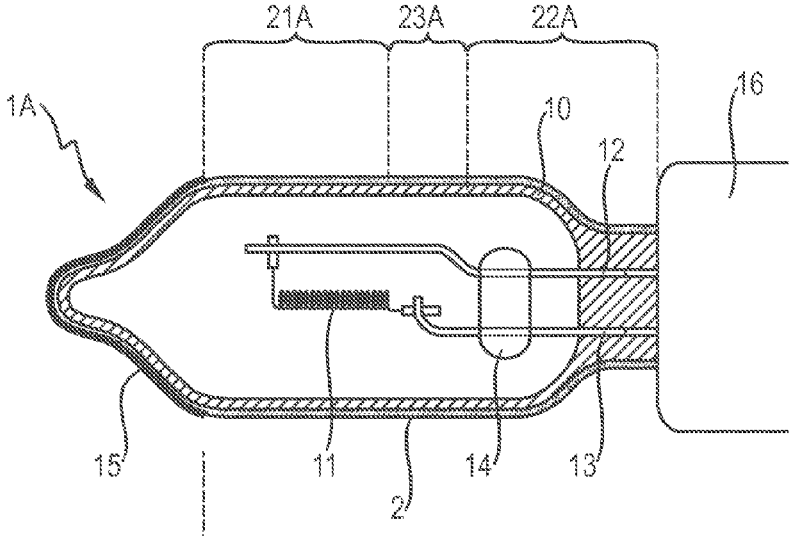
FIG. 2 shows a schematic representation of the filament lamp of FIG. 1 with an axially graded absorption coating according to the invention.

FIG. 2 shows a schematic representation of a H7 filament lamp 1A of the type shown in FIG. 1 with an axially graded absorption coating 2A applied to the outer surface of the envelope 10 to essentially entirely cover the outer surface of the glass envelope 10. The diagram shows a first coated region 21A and a second coated region 2A2 with a transition region 23A between the first and second coated regions 21A, 22A. In this embodiment, the transition region 23A is about 4 mm in width. For a coating thickness of 200 nm in the first coated region 21A and a coating thickness of 1000 nm in the second coated region 22A, the slope of the gradient in the transition region 23A is $0.2\times10^{-3}$.

Figure 3:
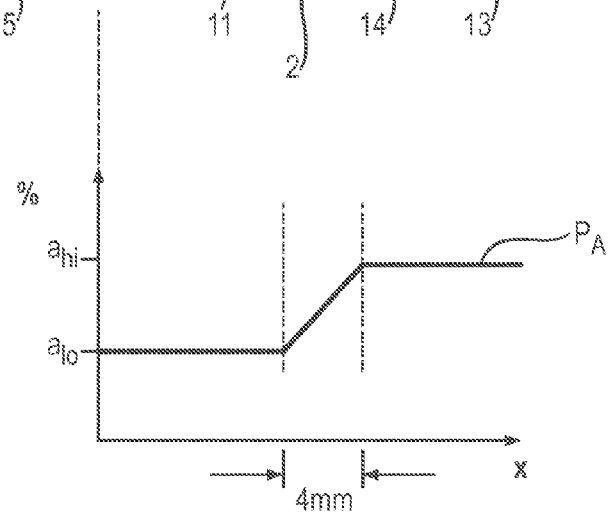
FIG. 3 shows a gradient profile for the graded absorption coating of FIG. 2.
Figure 4:
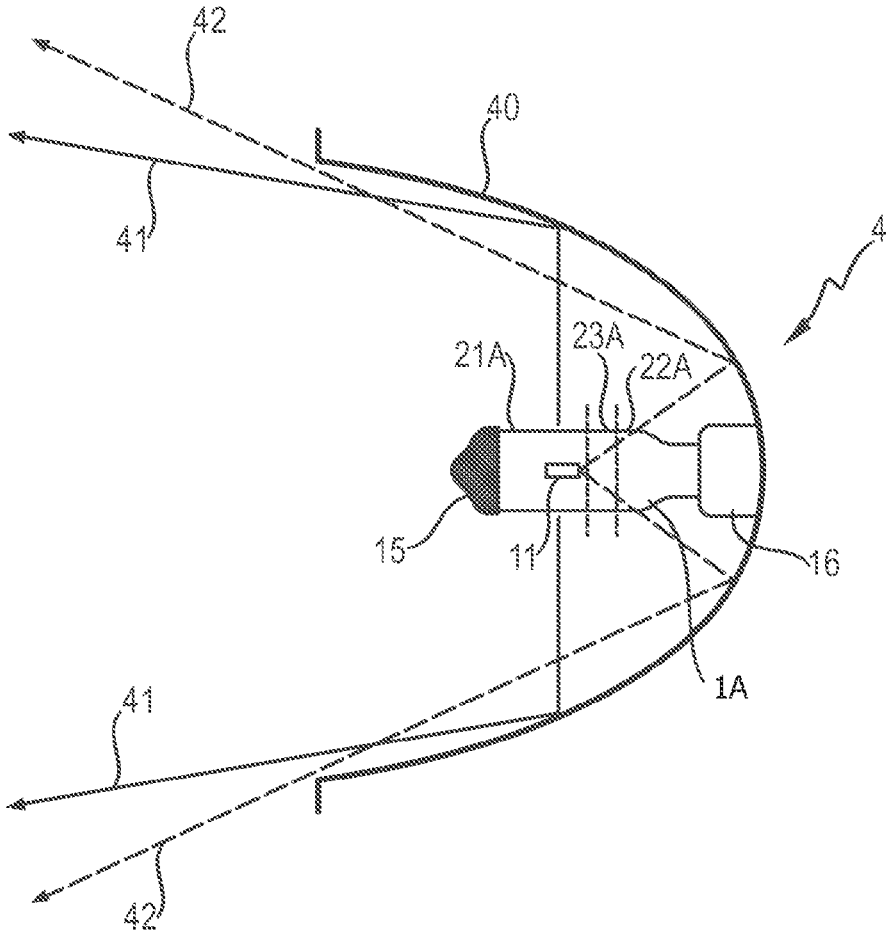
FIG. 4 shows a lighting assembly according to an embodiment of the invention.

FIG. 3 shows a gradient profile $P_A$ for an axially graded absorption coating such as that described in FIG. 2, commencing at the end of the anti-glare cap 15 and progressing to the base 16 (indicated on the X axis). The coating in the first region 21A results in a low level of absorption $a_{lo}$ (shown on the Y axis) of at most 15% of the light being absorbed as it passes through the envelope in that region. If a material such as cobalt (II) aluminate is used in this region, the front beam can be given a slight blue tint, i.e. the colour temperature of the light can be increased. The first coated region is followed by a transition region 23A in which the properties of the first and second regions 21A, 22A are effectively blended (the slope of the absorption gradient should not be confused with the slope of the graded coating in the transition region). In the second coated region 22A, the light is absorbed to a greater degree $a_{hi}$, in this example by about 30%. The different levels of absorption in the first and second coated regions 21A, 22A can be obtained by different layer thicknesses, different absorption particle densities, etc. The choice of cobalt (II) aluminate for the second coated region can result in a marked blue colour of the light leaving the lamp close to the lamp base, which light does not contribute to the main beam when used in a lighting assembly 4 according to an embodiment of the invention as shown in FIG. 4. Here, the lamp 1A is mounted in a reflector 40 shaped to collect images of the light source 11 exiting the lamp 1A through the first coated area 21A and shape a beam 41 using these images. The coating itself is not shown for the sake of simplicity. The remainder of the light leaving the lamp 1A towards the base of the lamp 1A, for example through the transition region 23A and the second coated area 22A, does not contribute to the beam 41. According to the invention, this light is given a pronounced blue colour and therefore gives the appearance of a xenon lighting assembly to anyone looking into the reflector, even though the lighting assembly only features a conventional H7 lamp.

Figure 5:
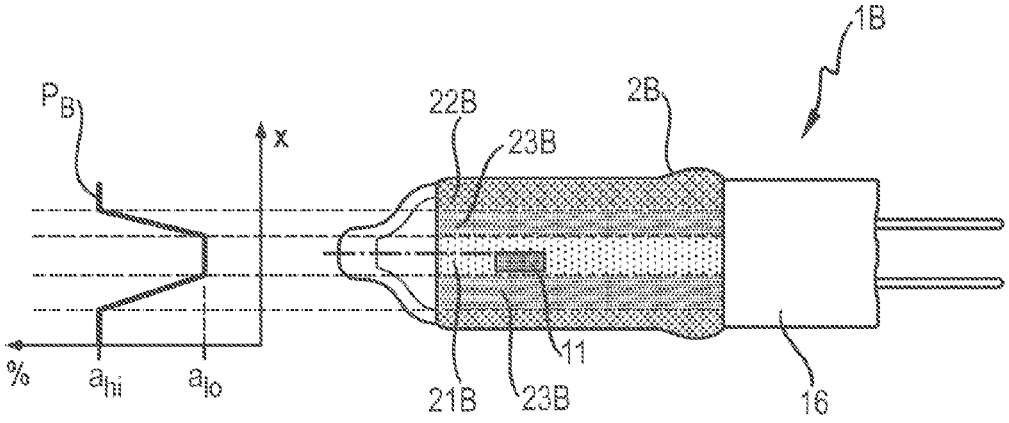
FIG. 5 shows a schematic representation of the filament lamp of FIG. 1, with a first circumferentially graded absorption coating according to the invention.

FIG. 5 shows a schematic representation of another lamp 1B with a first type of circumferentially graded absorption coating 2B and a gradient profile $P_B$ (shown on its side for the sake of clarity). Here, a first coated region 21B is applied along the length of the glass envelope 10, and a second coated region 22B is applied to the remainder of the envelope 10. In this embodiment, the first coated region 21B provides a thin strip of coating through which the light can pass largely unaffected or only slightly modified, with a corresponding low level of absorption $a_{lo}$, and the second coated region 22B can alter the light in that region to a greater extent and a greater level of absorption $a_{hi}$, for example by changing its colour, depending on the application for which the lamp is to be used. A transition region 23B ensures a smooth transition between the light portions emitted from the first and second coated regions 21B, 22B.

Figure 6:
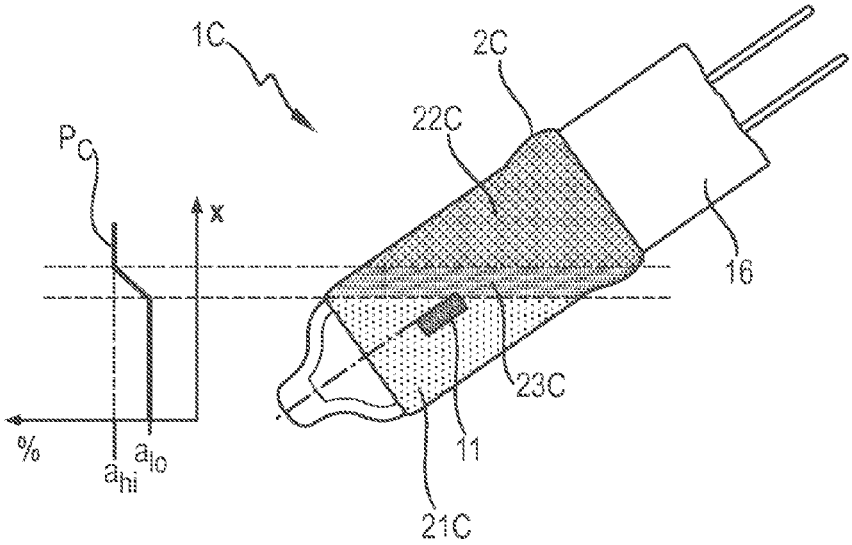
FIG. 6 shows a schematic representation of the filament lamp of FIG. 1, with a second circumferentially graded absorption coating according to the invention.

FIG. 6 shows a schematic representation of another lamp type 1C with a second type of circumferentially graded absorption coating 2C and a gradient profile $P_C$ (also shown on its side for the sake of clarity), in which the coating 22C is applied at a slant to the lamp 1C. Here, a thinner first coated region 21" with a corresponding low level of absorption $a_{lo}$ is applied to one side of the tip of the glass envelope 10, and a second coated region 22C and a greater level of absorption $a_{hi}$ is applied to the remainder of the envelope 10 including the outer regions 17. A transition region 23C ensures a smooth transition between the light portions emitted from the first and second coated regions 21C, 22C.

Figure 7:
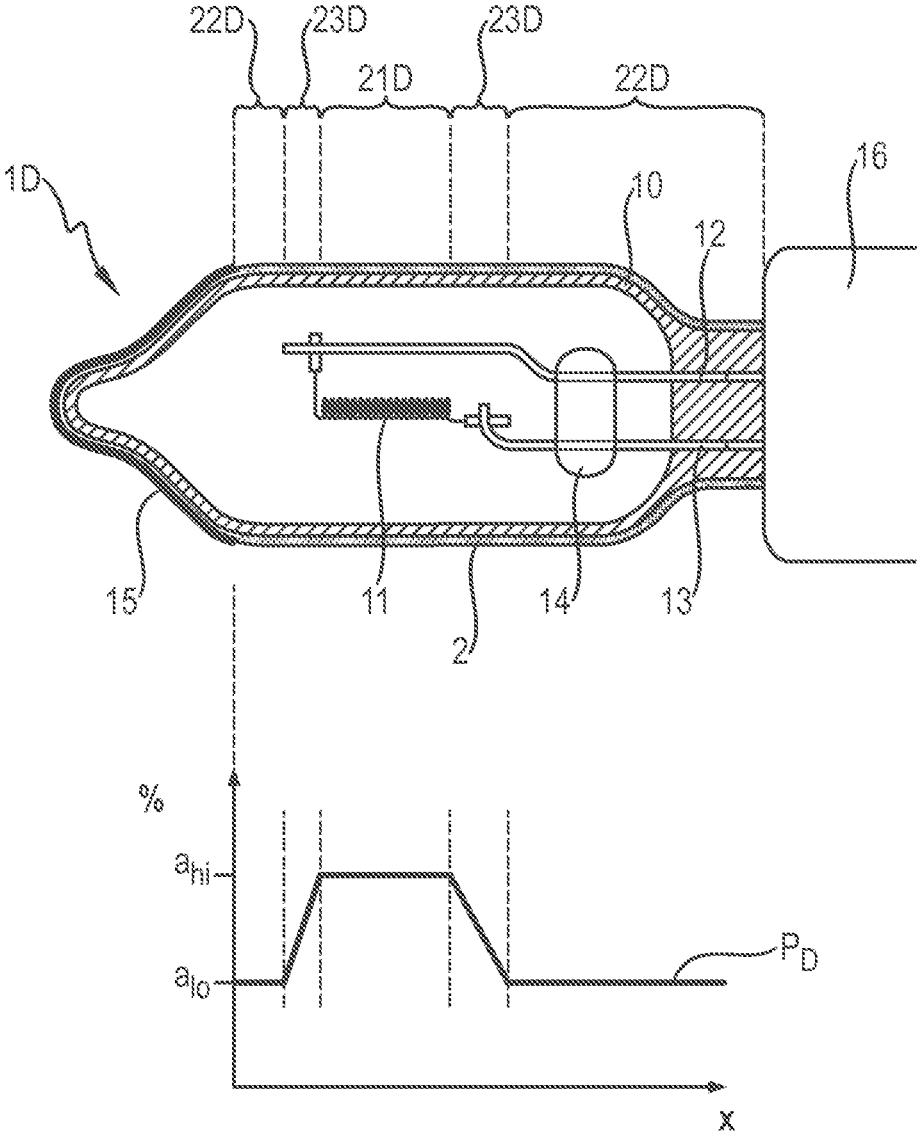
FIG. 7 shows a schematic representation of the filament lamp of FIG. 1, with a third circumferentially graded absorption coating according to the invention.

For a lamp with a graded coating applied so that the first coated region has a greater effect than the second coated region, the gradient profile could show a central region with a higher level of absorption than the outer regions, for example if a more absorptive coating is applied in the region of the filament, while a less absorptive coating is applied in the tip and base regions. Such a lamp 1D is shown in FIG. 7, with a graded coating 2D according to the invention, this time with a more absorptive first coated region 21D in the centre of the lamp 1D, and two less absorptive second coated regions 22D, one on either side of the first coated region 21D. These first and second coated regions 21D, 22D lie on either side of two transition regions 23D. The corresponding gradient profile $P_D$ is shown beneath the lamp 1D, and indicates a higher absorption level $a_{hi}$ in the first coated region 21D, and lower levels of absorption $a_{lo}$ in the outer coated regions 22D.

For a realisation in which a more absorptive coating is applied between the tip and into the filament region, with a less absorptive coating only in the base region, the gradient profile would essentially be a mirror image of the gradient profile shown in FIG. 3.

Although the present invention has been disclosed in the form of preferred embodiments and variations thereon, it will be understood that numerous additional modifications and variations could be made thereto without departing from the scope of the invention. For example, although a filament lamp was described in the above, the graded absorption coating can equally well be applied to the outer envelope of a gas-discharge lamp such as a D1-D4 lamp in order to obtain a specific beam performance or lamp appearance.

For the sake of clarity, it is to be understood that the use of "a" or "an" throughout this application does not exclude a plurality, and "comprising" does not exclude other steps or elements

The invention claimed is:

1. An automotive front lamp, comprising:

a light generating means;

a glass envelope enclosing the light generating means, the glass envelope comprising along its length a top part above the light generating means, a center part surrounding the light generating means, and a bottom part below the light generating means; and an absorption coating axially and/or circumferentially applied to a surface of the glass envelope, wherein exactly three coated regions are formed:

a first coated region in which light emitted by the light generating means undergoes a substantially uniform first level of absorption, wherein the first coated region is applied to the center part of the glass envelope;

a second coated region in which light emitted by the light generating means undergoes a substantially uniform second level of absorption, said second level of absorption being greater than the first level of absorption, wherein the second coated region is applied to the bottom part of the glass envelope so the second coated region is at a greater distance from the light generating means than the first coated region; and a transition region positioned between the first and second regions in which the absorption coating is graded thereby providing a transition in the transition region from the first coated region to the second coated region, whereby in use, light emitted by the lamp does not exhibit a pronounced step between neighboring regions.

2. A lamp according to claim 1, wherein the first coated region and the second coated region differ in layer thickness.

3. A lamp according to claim 2, wherein the absorption coating has a thickness in the range 200 nm to 500 nm in the first coated region and in the range 500 nm to 1000 nm in the second coated region.

4. A lamp according to claim 1, wherein the first coated region comprises low particle density and the second coated region comprises high particle density or the number of layers in the first coated region is less than the number of layers in the second coated region.

5. A lamp according to claim 1, wherein a refractive index of the first coated region and a refractive index of the second coated region differ by at most 0.2.

6. A lamp according to claim 1, wherein the absorption coating comprises a single layer of an absorption material.

7. A lamp according to claim 1, wherein the material of the absorption coating is chosen to raise the colour temperature of the lamp by at least 100K compared to an uncoated state of the lamp.

8. A lamp according to claim 1, wherein the absorption coating essentially entirely covers the surface of the glass envelope.

9. A lighting assembly comprising a lamp according to claim 1 and a reflector for collecting and shaping any light passing through the absorption coating of the lamp.

10. A lighting assembly according to claim 9, wherein the lamp comprises a H7 lamp with a light generating means comprises a filament, and the graded absorption coating is applied over the entire surface of the glass envelope of the lamp.

11. A lamp according to claim 1, wherein the first level of absorption is not greater than 15%.

12. A lamp according to claim 1, wherein the second level of absorption is approximately 30%.

13. A lamp according to claim 1, wherein the transition region ensures a smooth transition between light portions emitted from the first and second coated regions.

14. The lamp according to claim 1, further comprising:

an anti-glare cap attached to a top end of the glass envelope; and a socket attached to a bottom end of the glass envelope, wherein the second coated region changes light exiting the bottom part of the glass envelope into a blueish white light.

15. A method of manufacturing an automotive front lamp comprising a glass envelope enclosing a light generating means, the glass envelope comprising along its length a top part above the light generating means, a center part surrounding the light generating means, and a bottom part region below the light generating means, the method comprising axially and/or circumferentially applying an absorption coating to a surface of the glass envelope such that exactly three coated regions are formed:

a first coated region in which light emitted by the light generating means undergoes a substantially uniform first level of absorption, wherein the first coated region is applied to the center part of the glass envelope;

a second coated region in which light emitted by the light generating means undergoes a substantially uniform second level of absorption, said second level of absorption being greater than the first level of absorption, wherein the second coated region is applied to the bottom part of the glass envelope so the second coated region is at a greater distance from the light generating means than the first coated region;

a transition region positioned between the first and second regions, and in which the absorption coating is graded thereby providing a transition in the transition region from the first coated region to the second coated region to alter a front beam generated by the lamp;

whereby in use, light emitted by the lamp does not exhibit a pronounced step between neighboring regions.

16. A method according to claim 15, wherein the step of axially and/or circumferentially applying the absorption coating comprises the steps of:

immersing the glass envelope in a coating bath;

partially withdrawing the glass envelope from the coating bath at a first rate of withdrawal; and completely removing the glass envelope from the coating bath at a second rate of withdrawal whereby the first rate of withdrawal is gradually adjusted until the second rate of withdrawal is reached.

17. A method according to claim 15, wherein the step of axially and/or circumferentially applying the absorption coating comprises the steps of:

applying the coating essentially to the entire surface of the envelope; and removing a portion of the coating an area corresponding to the first coated region such that a thin layer of the absorption coating remains in that area.

18. The method according to claim 15, wherein the first level of absorption is not greater than 15%.

19. The method according to claim 15, wherein the second level of absorption is approximately 30%.

20. The method according to claim 15, further comprising:

attaching an anti-glare cap to a top end of the glass envelope; and attaching a socket to a bottom end of the glass envelope, wherein the second coated region changes light exiting the bottom part of the glass envelope into a blueish white light.

* * * * *